US008448370B2

(12) United States Patent
Williams

(10) Patent No.: US 8,448,370 B2
(45) Date of Patent: May 28, 2013

(54) QUICK RELEASE CONNECTOR FOR FIREARM CLEANING KIT AND METHOD FOR USING THE SAME

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 385 days.

(21) Appl. No.: 12/714,944

(22) Filed: Mar. 1, 2010

(65) Prior Publication Data

US 2011/0209379 A1 Sep. 1, 2011

(51) Int. Cl.
*F41A 29/00* (2006.01)

(52) U.S. Cl.
USPC ..... 42/95

(58) Field of Classification Search
USPC ..... 42/95; 15/104.03, 104.05; 403/353
See application file for complete search history.

(56) References Cited

U.S. PATENT DOCUMENTS

| | | | | | |
|---|---|---|---|---|---|
| 596,490 | A | * | 1/1898 | Edwards | 403/353 |
| 3,002,466 | A | * | 10/1961 | Read | 417/456 |
| 3,123,881 | A | * | 3/1964 | Westman | 24/701 |
| 4,716,673 | A | * | 1/1988 | Williams et al. | 42/95 |
| 5,074,699 | A | * | 12/1991 | Blaisdell et al. | 403/122 |
| 5,934,000 | A | * | 8/1999 | Hayes, Sr. | 42/95 |

* cited by examiner

*Primary Examiner* — Gabriel Klein
(74) *Attorney, Agent, or Firm* — Harris Beach PLLC

(57) ABSTRACT

Embodiments of the application can include a cleaning kit for a firearm and methods for using the same. Embodiments of a cleaning kit can include an elongated (e.g., flexible) shaft and different cleaning tips releasably attachable to and detachable from the shaft. First and second universal couplings can be respectively attached to ends of the shaft and cleaning tips to releasably attach the cleaning tips to the shaft. An adapter can have the first or second universal coupling on a first end and a retrofit coupler (e.g., internal or external threaded bore) on the second opposite end.

18 Claims, 14 Drawing Sheets

QUICK RELEASE CONNECTOR FOR FIREARM CLEANING KIT AND METHOD FOR USING THE SAME

FIELD OF THE INVENTION

This application relates to cleaning kits for firearms. More particularly, embodiments according to this application relate generally to gun barrel cleaning devices, and more particularly, to a firearm barrel cleaner having a shaft for use with one or more cleaning tools.

BACKGROUND OF THE INVENTION

There presently exists a genuine need for a firearm barrel cleaning device having a rigid or flexible shaft that is capable of cleaning a particular model firearm or a wide range of firearm barrels quickly and efficiently in combination with a plurality of different cleaning tools or cleaning tips.

SUMMARY OF THE INVENTION

Accordingly, it is an aspect of this application to address in whole or in part, at least the foregoing and other deficiencies in the related art.

It is another aspect of this application to provide in whole or in part, at least the advantages described herein.

It is another aspect of the present application to provide firearm cleaning kits that expedites the cleaning process.

It is another aspect of the present application to provide firearm cleaning kits including quick release connectors for use with a cleaning shaft or cleaning tips capable of withstanding moderate to high pulling stresses.

It is another aspect of the present application to provide firearm cleaning kits with quick release connectors between at least one cleaning shaft and at least one cleaning tip that connect and release by first and second movements in or along different directions (e.g., perpendicular directions).

It is another aspect of the present application to provide firearm cleaning kits with connectors between at least one shaft and at least one cleaning tip that connect and release by a first movement in a radial direction and a second pivoting movement to rotatably attach aligned to a longitudinal axis.

It is another aspect of the present application to provide firearm cleaning kits with universal couplings between at least one shaft and at least one cleaning tool that connect and release by a reversible radial, longitudinal and pivoting movements.

It is another aspect of the present application to provide firearm cleaning kits with universal couplings between at least one shaft and at least one cleaning tool that connect and release without using corresponding external and/or internal threads.

Another aspect of the present application is to provide firearm barrel cleaner which can clean a wide range of firearm barrels quickly and efficiently.

Still another aspect of the present application is to provide a gun barrel cleaner container that is compact and can fit within a sportsman's clothing pocket for easy storing and transporting of the gun barrel cleaner.

It is yet another aspect of the present application to provide an improved method of attaching a gun barrel cleaning tip to the flexible shaft to effect a more efficient cleaning of a gun barrel.

In one embodiment, a firearm barrel cleaner can include a firearm barrel cleaner comprising a shaft substantially unyielding in an axial direction; at least one cleaning attachment; at least one universal couplings, each coupling to include an engagement recess, said at least one universal coupling fixedly attached to the shaft or at least one cleaning attachment; and at least one universal tip fixedly attached to the other of the shaft or the at least one cleaning attachment, each of said universal cleaning tip to include a stem connector, the stem connector comprising a first engaging portion, and a second portion projecting from one end of each universal cleaning tip to the first engaging portion, where the second portion is smaller than the first portion, the engagement recess comprising a radial opening, a longitudinal slot extending between the radial opening and an end of the universal coupling, a first outer portion of the longitudinal slot sized to pass the second portion and a second inner portion of the longitudinal slot sized to pass the first engaging portion.

In another embodiment, a firearm cleaning kit can include a gun barrel cleaner comprising a firearm barrel cleaning shaft substantially unyielding in an axial direction and laterally bendable for compact coiling; at least one cleaning attachment; means for securing the at least one cleaning attachment to the firearm barrel cleaning shaft, the means for securing comprising extending means for inserting in a first direction and for rotating to a second orientation, and recessing engagement means for releasing the extending means in the first direction and for attaching the extending means in the second direction; wherein the at least one cleaning attachment is attachable and detachable to the firearm barrel cleaning shaft using the means for securing, and the extending means fixedly attached to the firearm barrel cleaning shaft or the at least one cleaning attachment, and the recessing engagement means fixedly attached to the other of the firearm barrel cleaning shaft or the at least one cleaning attachment.

In yet another embodiment, a method of using a firearm cleaning shaft can include a firearm barrel cleaning shaft extending longitudinally between a first end and a second end; a plurality of cleaning tools having a utility end and a distal attachment end; attaching a first cleaning tool to the firearm barrel cleaning shaft by radially inserting the attachment end into an engagement recess near the second end of the firearm barrel cleaning shaft and pivoting the inserted attachment end to align with a longitudinal axis of the firearm barrel cleaning shaft; and detaching the first axially aligned tool from the second end of the firearm barrel cleaning shaft by pivoting the attachment end of the first cleaning tool in the engagement recess to extend radially from the engagement recess and moving the attachment end radially out of the engagement recess of the firearm barrel cleaning shaft.

BRIEF DESCRIPTION OF THE DRAWINGS

Novel features that are characteristic of the embodiments of the application are set forth with particularity in the claims. The application itself may be best be understood, with respect to its organization and method of operation, with reference to the following description taken in connection with the accompanying drawings in which:

DESCRIPTION OF EMBODIMENTS

Figure 1:
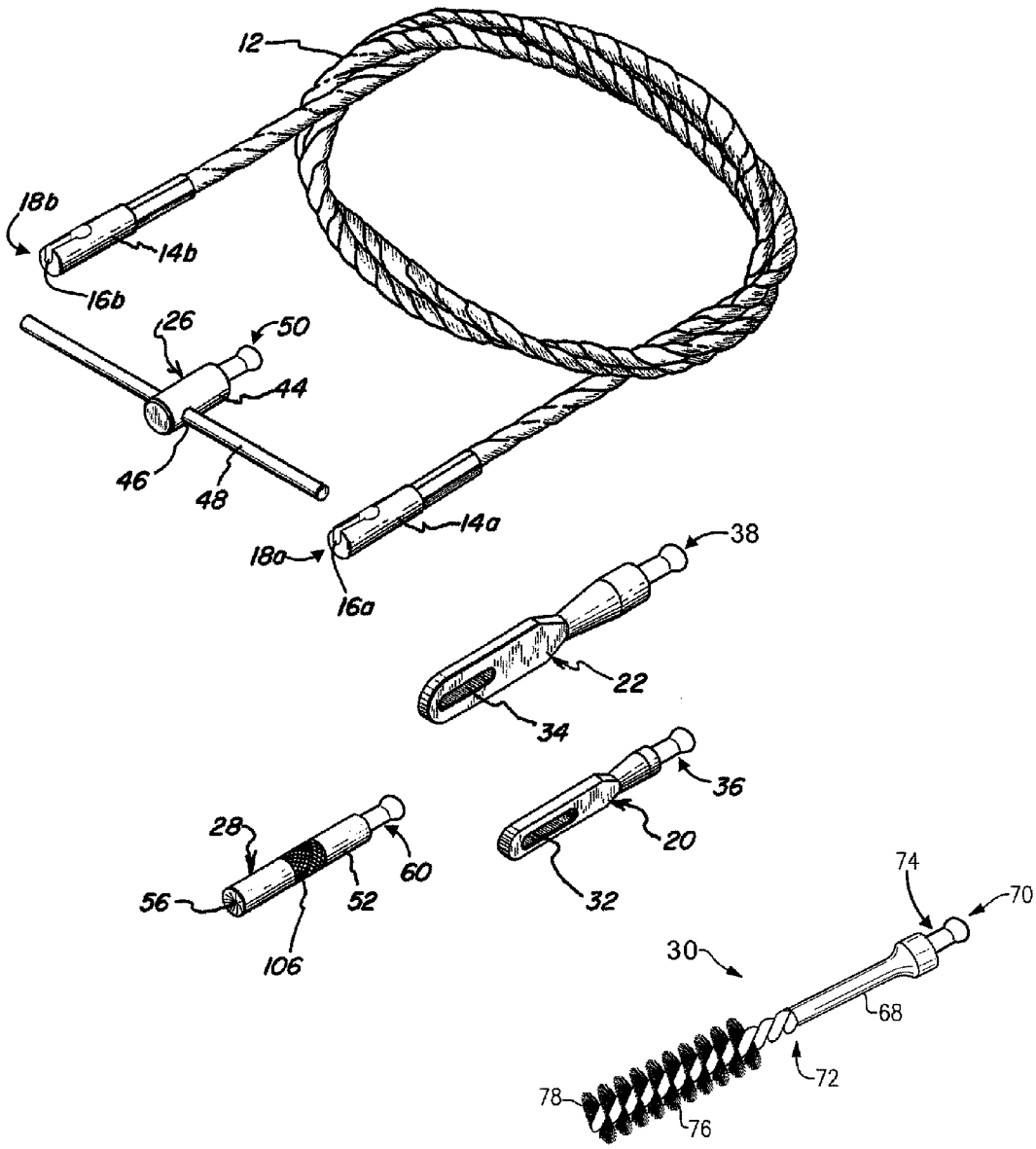
FIG. 1 is a diagram that shows a perspective view of one embodiment of a firearm cleaning kit having several exemplary different cleaning tips that can be selectively attached to a shaft using embodiments of a coupler according to the application.

One embodiment of a firearm cleaner or firearm cleaning kit, generally denoted as 10, is shown perspectively in FIG. 1. Firearm barrel cleaner 10 can include a flexible shaft 12 that is substantially unyielding in an axial direction for firearm barrel cleaning and laterally coilable for compact storing. Attached to opposite ends of shaft 12 are quick release universal coupling recess 14*a* and 14*b*. Each coupling 14*a* and 14*b* has a substantially identical engagement recess 16*a* and 16*b*, respectively, at a first end 18*a* and a second opposite end 18*b*. Using embodiments according to this application, the various cleaning attachments may be quickly and securely attached and removed from the shaft 12 for use in cleaning a firearm.

In the example shown, the flexible shaft 12 is a multi-strand braided wire with plastic coating. Other materials could be used for coating the multi-strand braided wire, e.g., vinyl, polyethylene, or polypropylene. The plastic-coated wire may be conveniently coiled and stored (e.g., in the pocket) when not in use. The flexible shaft 12 should be longer than the firearm barrel to be cleaned. Selectively detachable and attachable to the universal coupling recess 14*a* and 14*b* are exemplary interchangeable cleaning tips or cleaning tools 20, 22, 26, 28, and 30. The cleaning tools 20, 22, 26, 28, and 30 can be used for cleaning firearm barrels. Additional different cleaning tools may be used.

Exemplary cleaning tools 20 and 22 each have a cleaning patch receiving slot 32 and 34 therein, respectively. Cleaning tools 20, 22 can secure a cleaning patch. The cleaning patch can include at least one slit through which the cleaning tools 20, 22 can be respectively placed in order to secure the cleaning patch for cleaning. Cleaning tool 20 is dimensioned to pass through and effectively clean (e.g., when combined with a cleaning patch) a rifle barrel and cleaning tool 22 is dimensioned to pass through and effectively clean a shotgun barrel. Exemplary cleaning tools for interchangeable use within firearm barrel cleaner 10 can include various sizes corresponding to various types, models, or makes of firearms. A quick-connect stem 36 capable of detachably engaging either universal coupling recess 14*a* or 14*b* can be provided at one end of cleaning tool 20. Because it is dimensioned for cleaning a shotgun barrel, cleaning tool 22 has a larger radial dimension, but can also include quick connect stem 38 at an end of a shank of the cleaning tool 22.

Embodiments of a connector can include an engagement between universal coupling recess 14*a* or 14*b* and one of stems 36, 38, 50, 60, 70.

Another exemplary attachment for the shaft 12 can be exemplary cleaning tool 30 that can include a bore brush. The bore brush cleaning tool 30 can include a core 68 defining a first end 74 and a second end 72. In the example shown, the core 68 can be made of brass and includes a stem 70 on the first end 74 to couple to the universal coupling recess 14*a* and 14*b* (e.g., of the shaft 12). The core 68 further includes a hollowed-out or tubular segment on the second end 72 into which a brush portion 76 is inserted. Once inserted, the second end 72 may be formed to secure the brush portion 76 in place. The brush portion 76 can include wire-wound strands of brass securing a plurality of bristles 78. The bristles 78 are preferably brass to aid in scraping residue from the barrel of a firearm.

Exemplary cleaning tool 26 can include a T-shaped handle including an elongated portion 44 having a smooth transverse bore 46 therethrough. Located within bore 46 is a cylindrical bar 48. One end of cleaning tool 26 has a quick-connect stem 50 for detachable engagement with either coupling 14*a* or 14*b*. Firearm barrel cleaner 10 is capable of withstanding significant pulling force or pressure without breaking. Cleaning tool 26 facilitates the application during gun barrel cleaning of moderate to high pulling pressure by providing structure by which an individual can securely grip the gun barrel cleaner.

Figure 2:
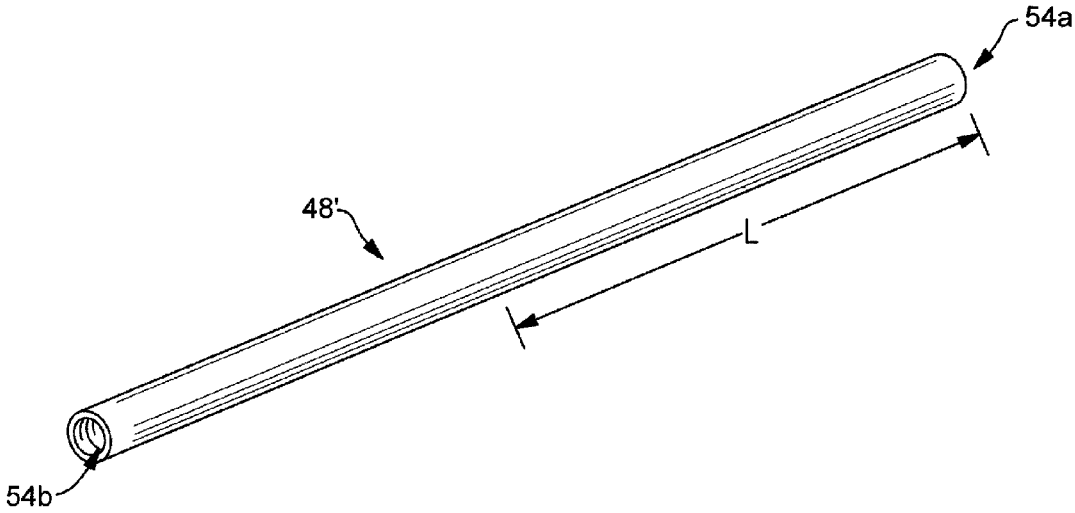
FIG. 2 is a diagram that shows a perspective view of an exemplary tee handle bar of FIG. 1.

In one embodiment as shown in FIG. 2, a first end 54*a* of a cylindrical bar 48' for the cleaning tool 26 may be slightly larger than the diameter of the bore 52. The larger diameter may extend for a length "L" and taper to the nominal diameter of the bar 48'. In this manner, a second end 54*b* of the bar 48' may slide through the bore 46 in the elongated portion 44, but will only slide up to the larger diameter, thus positioning the bar 48' at its mid-section. A knurl (not shown) may be formed on the elongated portion 44 to aid in handling cleaning attachment 26.

Exemplary cleaning tool 28 can include a gun barrel bore obstruction remover. Cleaning tool 28 has a cylindrical body portion 52 dimensioned for cleaning a rifle barrel. Cleaning tool 28 can have a concave face 56 at one end and a quick-connect stem 60, at the other end. Concave end face 56 can assist in the safe removal of bullet obstructions. Quick-connect stem 60 is dimensioned to detachably engage either universal coupling recess 14*a* or 14*b*. When attached to shaft 12, cleaning tool 28 operates to dislodge a gun barrel bore obstruction by impacting the obstruction. Because of this, cleaning tool 28 is preferably solid and manufactured from a fairly heavy material so as to provide sufficient impacting weight.

Figure 3A:
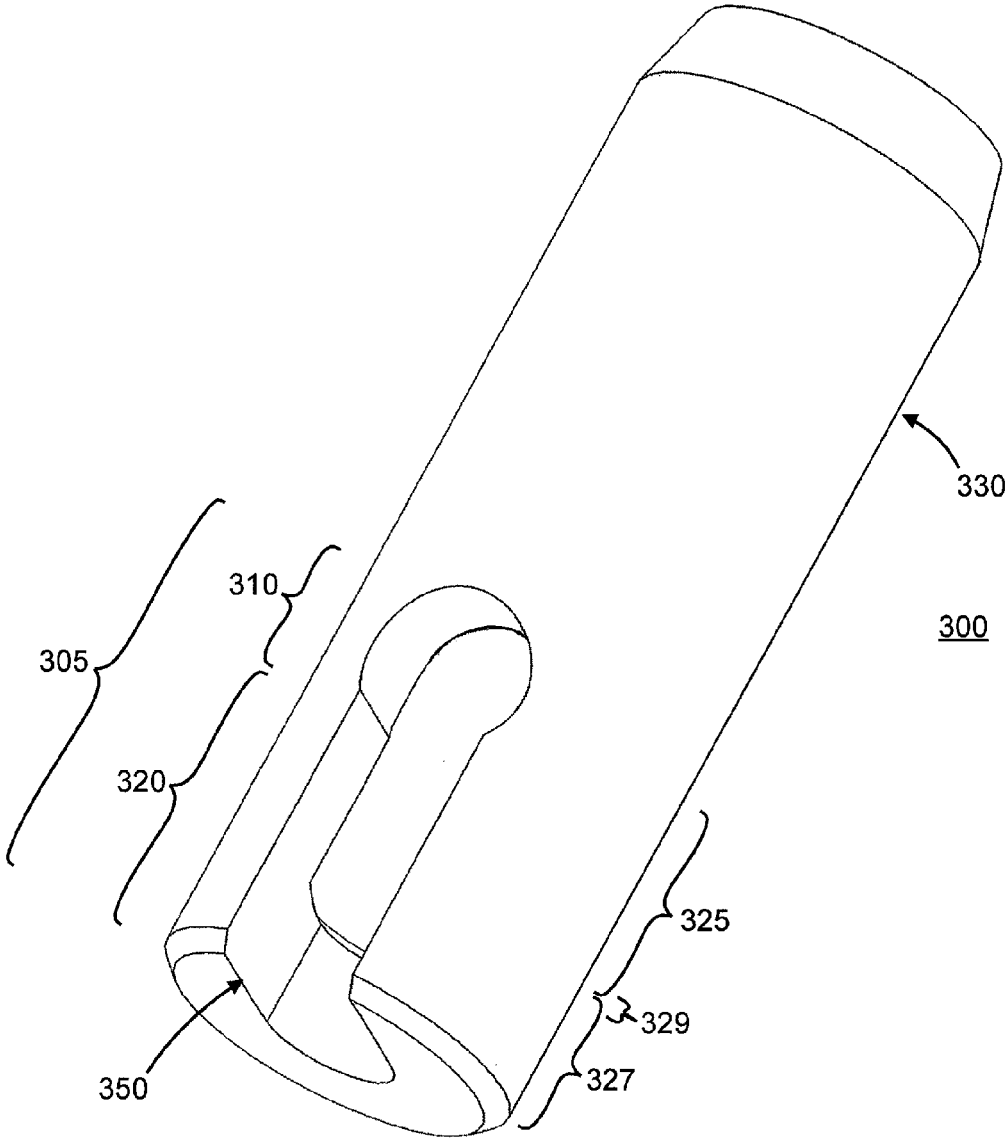
FIG. 3A is a diagram that shows a perspective view of an exemplary universal coupling for use in firearm cleaning kits or tools according to embodiments of the application.

FIG. 3A is a diagram that shows a universal coupling for use in firearm cleaning kits or tools according to exemplary embodiments of the application. An exemplary embodiment of a universal coupling recess 300 can include a recess to receive and hold a corresponding stem. As shown in FIG. 3A, universal coupling recess 300 can be used for universal coupling recess 14*a*, 14*b*; however, embodiments of the application are not intended to be so limited. An engagement recess 305 can be used to detachably engage a universal tip of a cleaning tool (e.g., stem 805).

Figure 3B:
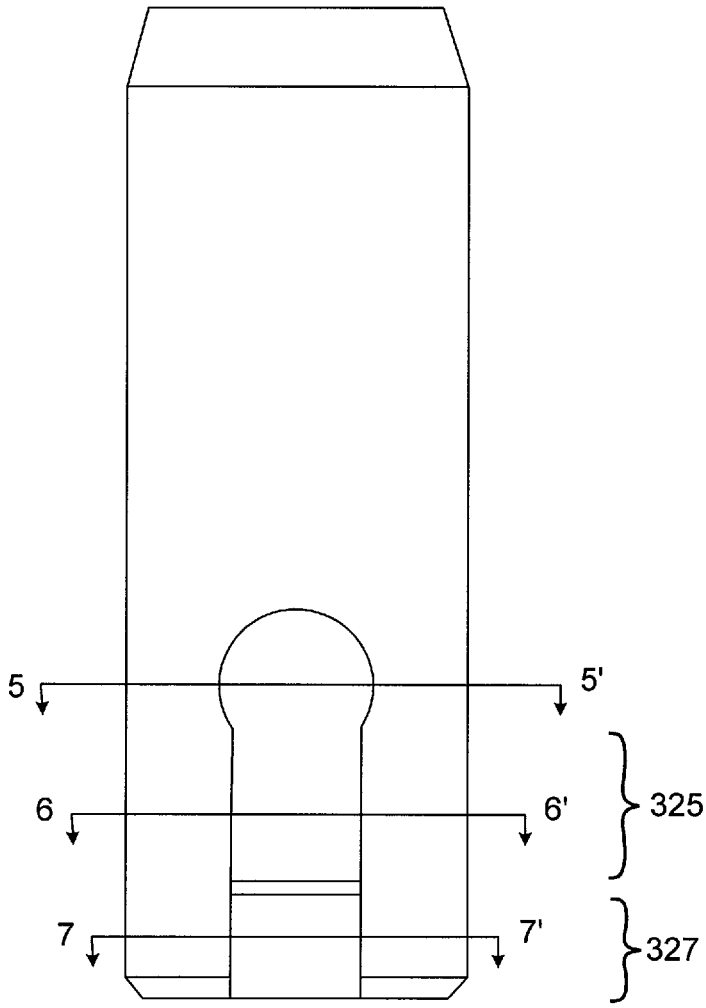
FIGS. 3B-3C are diagrams that show top and lateral side views of an exemplary universal coupling engagement recess according to an embodiment of the application.
Figure 3C:
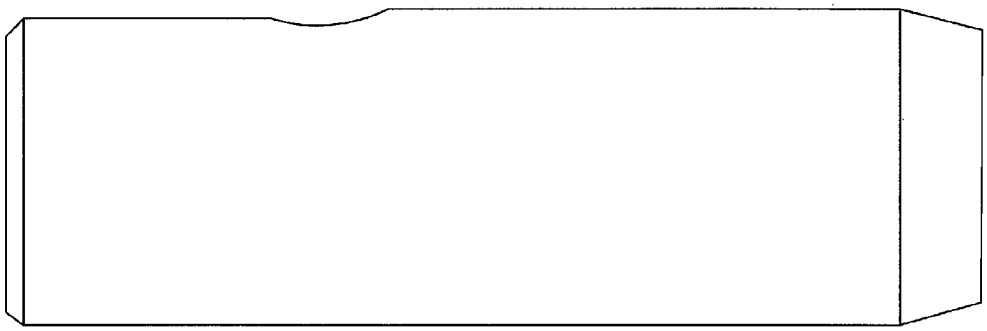
Figure 4:
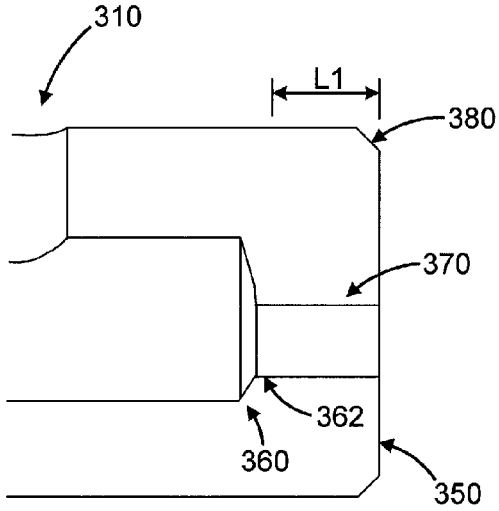
FIG. 4 is a diagram that shows a cross-section of a portion of a universal coupling engagement recess according to an embodiment of the application.

A perspective view of an engagement recess for a universal coupling is shown in FIG. 3A. Top and lateral side views of a universal coupling engagement recess are shown in FIGS. 3B-3C. A cross-sectional view of a portion of an engagement recess is shown in FIG. 4. In one embodiment, coupling 300 can have a generally cylindrical shape and be affixed to the first end 18*a* and/or the second end 18*b* of shaft 12. In one embodiment, an engagement recess 305 can include an aperture and a slot.

As shown in FIG. 3A, an engagement recess 305 in the coupling 300 can include an opening 310 and a channel 320. The radial opening (e.g., circular hole) 310 can extend from a prescribed depth (e.g., above or lower than longitudinal axis 340 of coupling 300) to be exposed in an outer surface of the coupling 300. For example, a size or width of the radial opening 310 can be uniform along its depth into the engagement recess 305.

Figure 6:
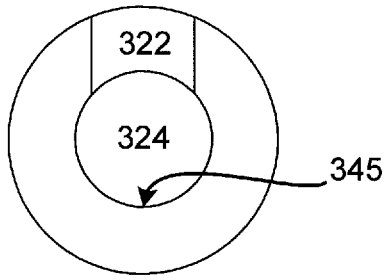
FIG. 6 is a diagram that shows a side view of a cross-section along lines 6-6' of an engagement recess of a universal coupling in FIG. 3B.

As shown in FIGS. 3A and 6, in one embodiment the channel 320 can include an upper portion 322 and a lower portion 324 as the channel 320 extends along from the radial opening 310 to an end 350 of the coupling 300. The channel 320 can include a first portion 325, and a second portion 327 as the channel 320 extends from the radial hole 310 to the end 350 of the coupling 300. In one embodiment, the channel 320 can include a third portion 329 to transition (e.g., gradually) from the dimensions of the first portion 325 to the dimensions of the second portion 327. The first portion 325 can be an inner longitudinal portion and the second portion 327 can be an outer locking longitudinal portion.

The first portion 325 is dimensioned to longitudinally pass the stem 805 (e.g., first portion 810) and the second portion 327 is dimensioned to retain or lock the stem 805 (e.g., first portion 810). When the stem 805 has traveled along channel 320 as far as possible (e.g., reached the locking portion), the stem 805 can be pivoted from a radial orientation to a longitudinal orientation aligned with the longitudinal axis 340 of the coupling 300. For example, a longitudinal axis of the shank of the cleaning tool affixed to the stem can be aligned to the longitudinal axis 340 of the coupling 300 and/or shaft 12 when attached.

Figure 8A:
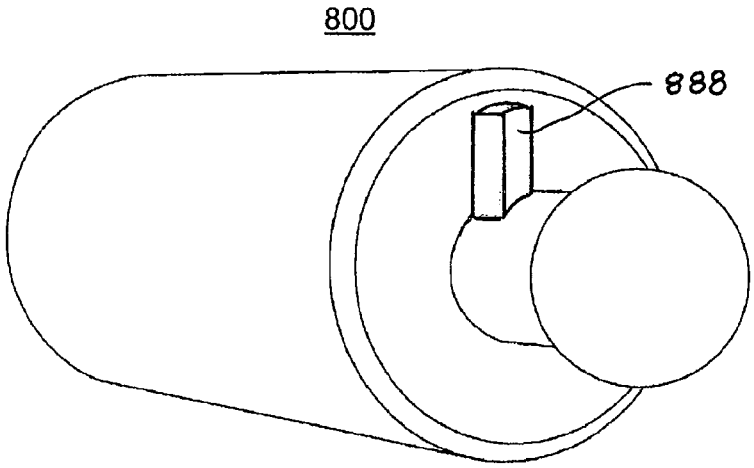
FIG. 8A is a diagram that shows a perspective view of an exemplary universal tip according to an embodiment of the application.
Figure 8B:
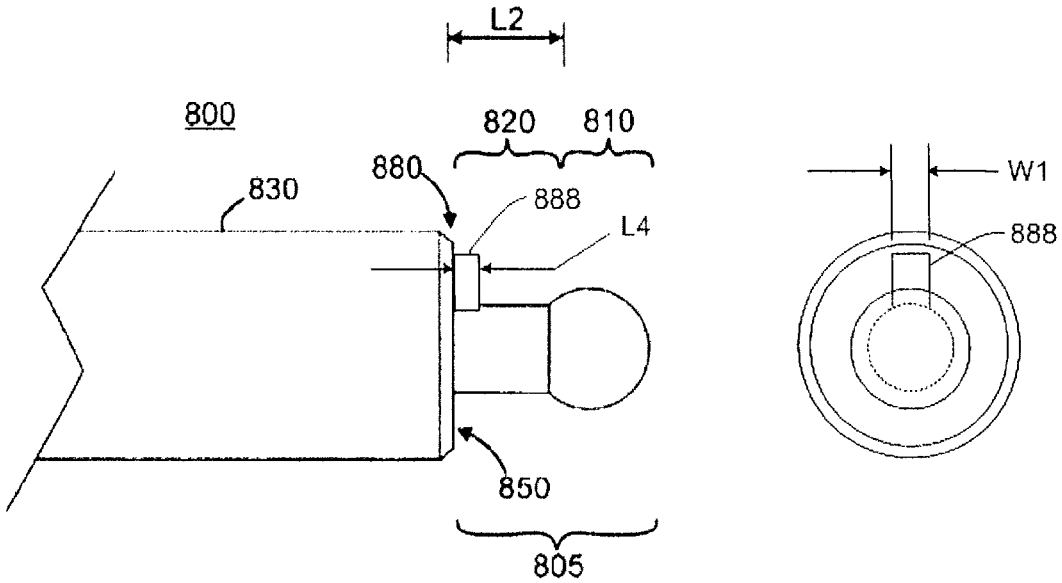
FIG. 8B is a diagram that shows a lateral side view of a universal tip shown in FIG. 8A.

As shown in FIGS. 8A-8B, in one embodiment, the stem 805 of universal coupling tip 800 can include a first portion 810 and a second portion 820. The first portion 810 can include dimensions to pass through the radial hole 310 and not to pass through the upper portion 322 or the second portion 327 of the channel 320. The second portion 820 can include dimensions to pass through the upper portion 322 of the channel 320 through both the first portion 325 and the second portion 327.

In one embodiment, the stem 805 can enter to reach a bottom surface 345 of the radial opening 310 while positioned in an orientation radially extending from a surface 330 or a center longitudinal axis 340 of the coupling 300. The stem 805 can then pass longitudinally through the first portion 325 of the channel 320 while maintaining the same radially extending orientation. However, when reaching the smaller dimensions of the lower portion 324 of the channel 320 in the second portion 327 (e.g., in locking portion), additional longitudinal force will result in the stem 805 perpendicularly rotating (e.g., in a plane parallel to the plane of a side surface of the channel 320) until becoming axially aligned (e.g., the center axis) with the coupling 300. The stem 805 (e.g., first portion 810 and second portion 820) can be rotatably attached in the axially aligned position so that the stem 805 and/or universal coupling tip 800 (e.g., shank of the cleaning tool) can spin while axially aligned. When axial force is applied to pull the second end 18*b* of the shaft 12 opposite to the first coupling 14*a* attached to the universal coupling tip 300, the axial force can maintain the stem 805, and corresponding cleaning tool in an axially aligned operational position for cleaning (e.g., attached to the shaft 12). In this example, pulling the second end 18*b* of the shaft 12 through a firearm barrel followed by the first end 18*a* can keep an attached cleaning tool and stem 805 in the coupling 300 in the aligned portion.

As shown in FIG. 4 in one embodiment, a length of the first portion 810 that is sufficient to clear a corner 380 at the end 350 of the coupling 300 can provide for limited axial movement when attached (e.g., L2<L1), which can allow the stem 805 to spin or rotate in the aligned portion. Further, the shape of the first portion 810 and/or the corresponding channel 320 (e.g., locking portion) are configured to promote or allow the stem 805 to rotate and be held in the axially aligned position. In one embodiment, a portion at an outer edge (e.g., circumference) of the end 350 can be removed to form the corner 380.

FIG. 4 is a diagram that shows a cross-sectional view of the universal coupling recess 300 including the engagement recess 305. As shown in FIG. 4, a third portion 329, for example, can be formed by a conical portion transitioning from a larger outer diameter 360 to a smaller inner diameter 362. As shown in FIG. 4, the transition in the third portion 329 is a linear transition between different sized cylindrical holes (e.g., frustoconical or geometric form based on a cone of which the top has been "cut-off" leaving only its base). However, other shapes or transitions (e.g., linear or non-linear) can be used in the third portion 329. Further, line 370 indicates the transition from parallel sides in the channel 320 to a rounded curved surface in the lower portion 324 of the second portion 327.

Figure 5:
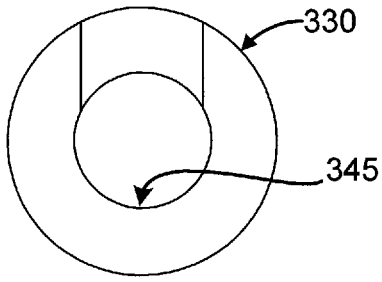
FIG. 5 is a diagram that illustrates a side view of a cross-section along lines 5-5' of an engagement recess of a universal coupling in FIG. 3B.
Figure 7:
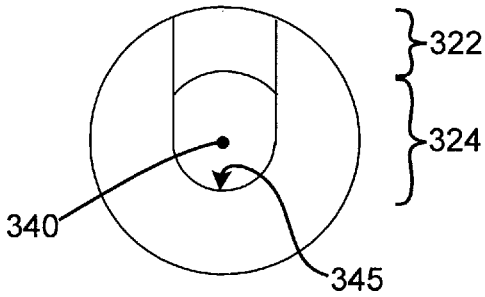
FIG. 7 is a diagram that shows a side view of a cross-section along lines 7-7' of an engagement recess of a universal coupling in FIG. 3B.

FIG. 5 shows a side view of a cross section of the engagement recess 305 in the universal coupling recess 300 along lines 5-5' in FIG. 3B. FIG. 6 shows a side view of a cross-section of the engagement recess 305 in the coupling 300 along lines 6-6' in FIG. 3B. FIG. 7 shows a side view of a cross-section of the engagement recess 305 in the coupling 300 along lines 7-7' in FIG. 3B.

As shown in FIG. 5, a radial opening 310 can be equal or different (e.g., smaller, larger) in size (e.g., diameter, width) at a surface 330 of the coupling 300 than a bottom surface 345 of the engagement recess 305. Further, the radial opening 310 can equal or be different in size than a size diameter (e.g., width) of the lower portion 324 in the first portion 325 of the recess. However, embodiments are not intended to be so limited as the shape of the radial opening 310 can change linearly or non-linearly tapered or stepped descending from the surface 330. Further, FIG. 7 illustrates that the lower portion 324 of the channel 320 can transition to be smaller in size in the second portion 327 than the first portion 325. In one embodiment, the lower portion 324 in the second section 327 can have a diameter equal to the width of the upper portion 322 of the channel 320. In one embodiment, the bottom surface 345 of the channel 320 at the end 350 of the coupling 300 can have a diameter of a curved semicircle equal to the width of the upper portion 322 of the channel 320.

FIG. 8A is a diagram that illustrates a perspective view of a universal coupling tip 800 including the stem 805. In one embodiment, the universal coupling tip 800 is fixedly attached or integral to the shank of a cleaning tool such as cleaning tools 20, 22, 26, 28, or 30. For example, universal coupling tip 800 can be connected to or integrally formed as part of the shank of various cleaning tools (e.g., cleaning tool core) in a firearm cleaning kit. For example, the stem 805 can be used as stems 36, 38, 50, 60, and/or 70 as shown in FIG. 1.

FIG. 8B is a diagram that illustrates a side view of the universal coupling tip 800 of FIG. 8A. As shown in FIG. 8B, the stem 805 can include the first portion 810 to be placed in an engaging relationship with the engagement recess 305 and the second portion 820 smaller in size (e.g., diameter, width, radius, height) than the first portion 810. The second portion 820 fixedly attaches the first portion 810 to an end 850 or a body 830 of the universal coupling tip 800. In one embodiment, an angled corner 880 can provide a transition from the end 850 to the body 830 of the universal coupling tip 800. As shown in FIG. 8B, a length L2 of the second portion 820 is greater than a length L1 of the second portion 327 of the channel 320. Thus, when the stem 805 is axially aligned and engaged in the recess 305, a space exists between the body 830 of the universal coupling tip 800 and the end 350 of the coupling 300. In one embodiment, as shown in FIG. 10A, L2 equals L1 plus L3.

Figure 9:
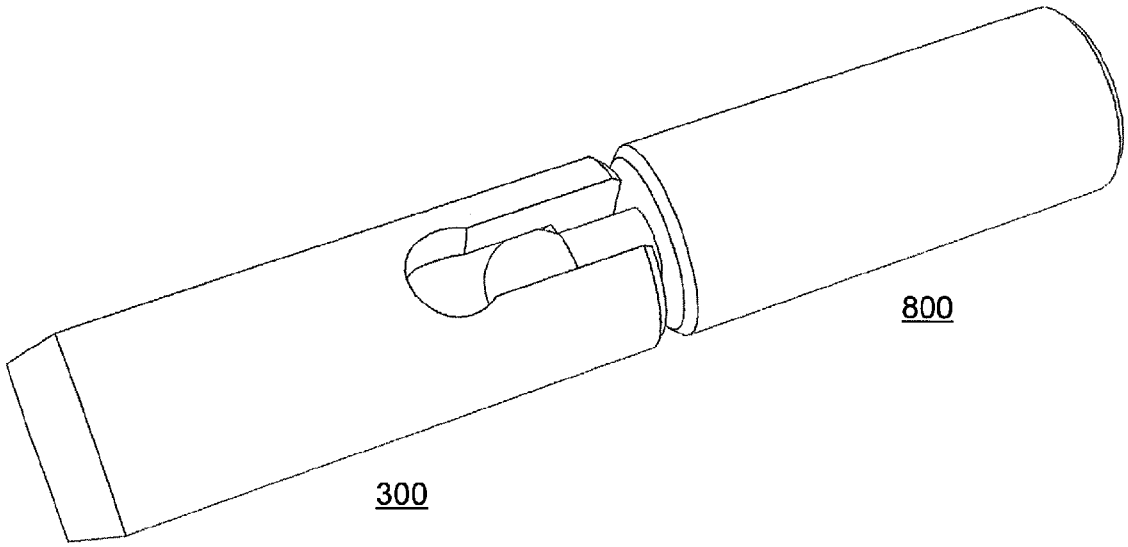
FIG. 9 is a diagram that illustrates a perspective view of an exemplary universal tip attached in an exemplary engagement recess according to an embodiment of the application.

FIG. 9 is a diagram that illustrates a perspective view of the universal coupling tip 800 engaged in the engagement recess 305 and axially aligned with a center axis of the coupling 300. The shank of a cleaning tool fixed to universal coupling tip 800 and the shaft 12 fixed to universal coupling recess 300 are not shown in FIG. 9.

Figure 10A:
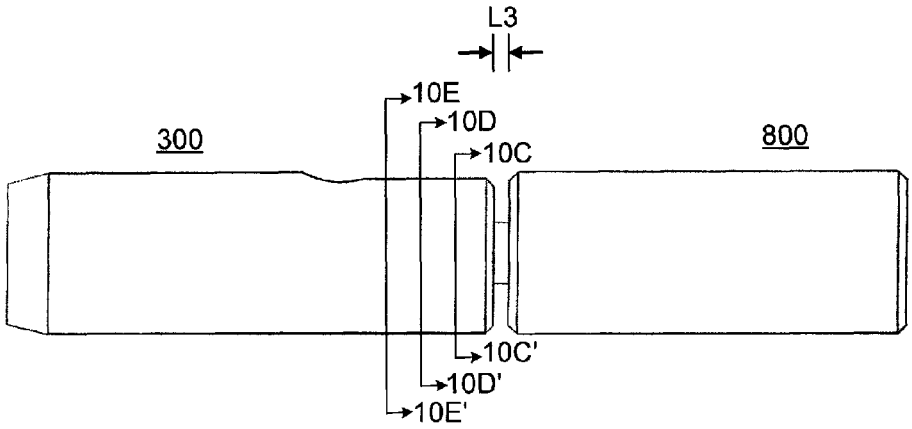
FIG. 10A is a diagram that illustrates a side view of FIG. 9.
Figure 10B:
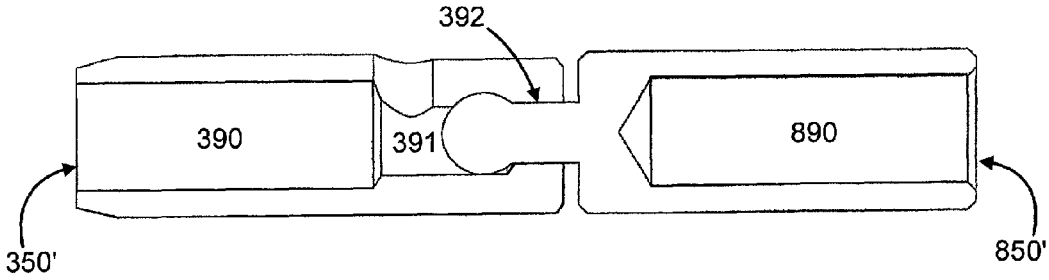
FIG. 10B is a diagram that shows a side view of a cross-section through center axis of FIG. 10A.

FIG. 10A is a diagram that illustrates a side view of FIG. 9. FIG. 10B is a cross-section through the center axis of the universal coupling recess 300 and universal coupling tip 800 shown in FIG. 10A. As shown in FIG. 10B, the universal coupling tip 800 can include an aligned cylindrical hole extending from end 850' toward end 850 that terminates in a cone shape. For example, cylindrical hole 890 can be used to affix the universal coupling tip 800 to a shank of the cleaning attachments such as cleaning tools 20, 22, 26, 28, and 30. However, embodiments of the universal coupling tip 800 are not intended to be so limited as other shapes may be used for the hole and/or various methods may be used to fix the universal coupling tip 800 to the shank of the exemplary cleaning tools.

As shown in FIG. 10B, in one embodiment, the coupling 300 can include a first cylindrical hole extending from an opposite end 350' toward the end 350 of the coupling 300. The hole 390 can be used to fix the coupling 300 to the ends 18*a*, 18*b* of the shaft 12. In one embodiment, a lower portion 324 of the channel 320 can be formed by a second smaller cylindrical hole 391 extending from the cylindrical hole 390. Further, a lower portion of the opening at the end 350 of the coupling 300 can be formed by a third smaller third cylindrical hole 392 extending from the second cylindrical hole 391 to the end 350. In one embodiment, a conical transition can be included to connect between the first cylindrical hole 390 to the second cylindrical hole 391 and between the second cylindrical hole 391 to the third cylindrical hole 392. In one embodiment, the cylindrical holes 390, 391, 392 can extend from the end 350 to the opposite end 350' of the coupling 300. In one embodiment, the cylindrical holes 390, 391, 392, 890 are centered about a center longitudinal axis of the universal coupling recess 300 and universal coupling tip 800, respectively. As shown in FIG. 10B, the bottom surface 345 may be stepped or change in depth throughout the engagement recess 305.

Figure 10E:
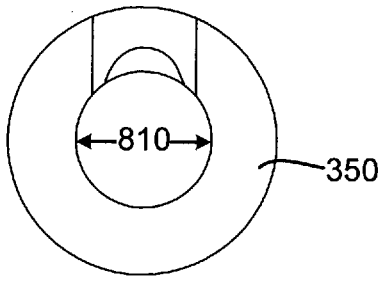
FIG. 10E is a diagram that shows an end view of a cross section of the stem 805 in the engagement recess 305 along lines 10E-10E' in FIG. 10A.
Figure 10D:
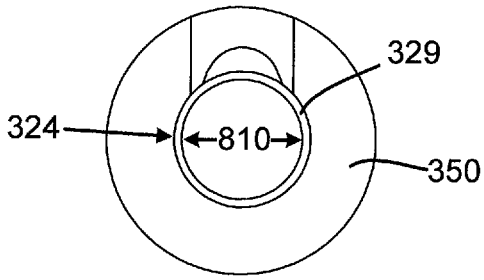
FIG. 10D is a diagram that shows an end view of a cross section of the stem 805 in the engagement recess 305 along lines 10D-10D' in FIG. 10A.
Figure 10C:
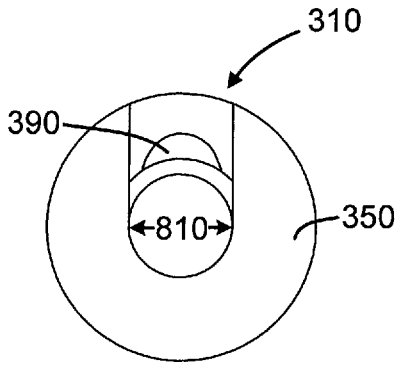
FIG. 10C is a diagram that shows an end view of a cross section of the stem 805 in the engagement recess 305 along lines 10C-10C' in FIG. 10A.

FIG. 10C shows an end view of a cross section of the stem 805 in the engagement recess 305 along lines 10C-10C' in FIG. 10A. FIG. 10D shows an end view of a cross section of the stem 805 in the engagement recess 305 along lines 10D-10D' in FIG. 10A. FIG. 10E shows an end view of a cross section of the stem 805 in the engagement recess 305 along lines 10E-10E' in FIG. 10A.

Figure 11:
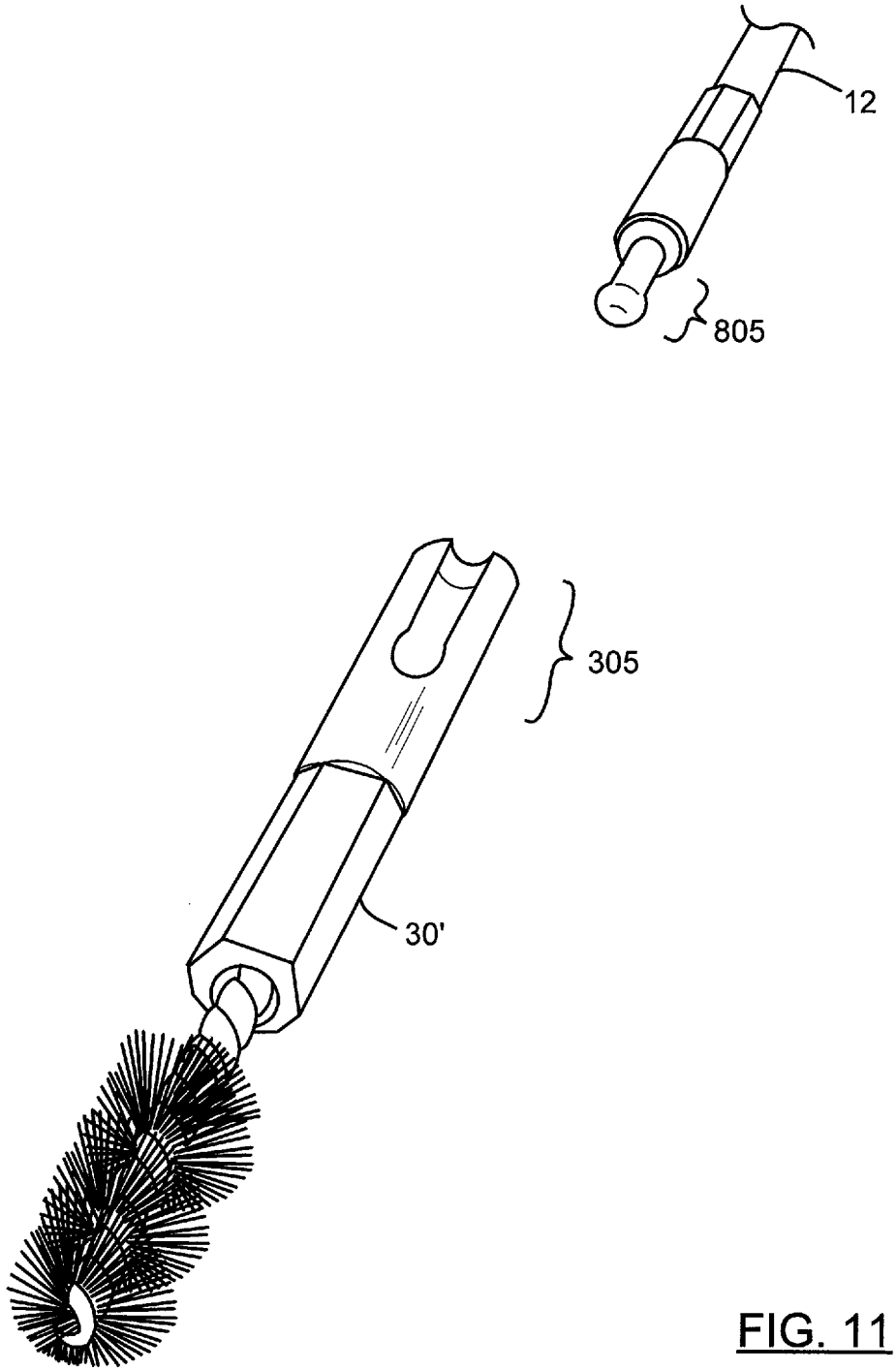
FIG. 11 is a diagram that shows a perspective view of exemplary universal couplings and universal tips according to an embodiment of the application.

FIG. 11 is a diagram that illustrates a perspective view of another embodiment of a firearm barrel cleaner according to the application. As shown in FIG. 11, universal coupling tip 800 is mounted to the shaft 12 and universal coupling recess 300 is affixed to a bore brush cleaning attachment 30'.

Figure 12:
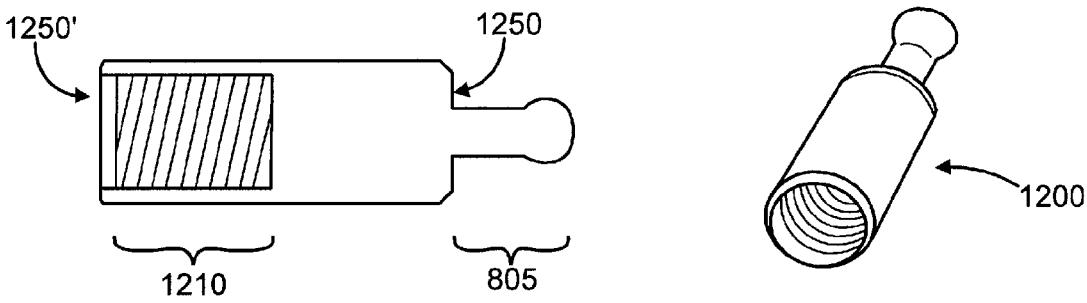
FIG. 12 is a diagram that shows a perspective view and cross-sectional view of an exemplary universal adapter according to an embodiment of the application.
Figure 13:
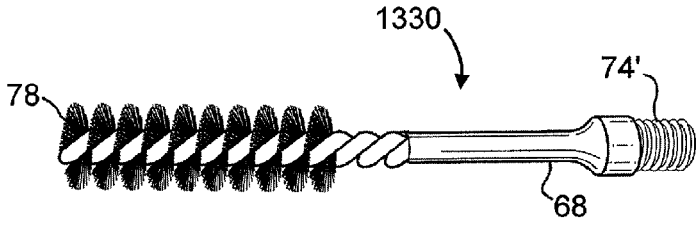
FIG. 13 is a diagram that shows an exemplary cleaning tool having a threaded end.

FIG. 12 is a diagram that illustrates a perspective view of a universal adapter according to exemplary embodiments of the application. As shown in FIG. 12, the universal coupling adapter 1200 includes at one end 1250 a universal coupling tip or the stem 805. At an opposite end 1250' of the universal coupling adapter 1200 is an internally threaded bore 1210. The internally threaded bore can be used to thread the universal coupling adapter 1200 onto cleaning tools having a shank terminating in an external threaded portion. FIG. 13 illustrates a bore brush cleaning tool 1330 that has an external thread 1374 terminating the core 1368 of the cleaning tool. By threading a shank of the bore brush cleaning tool 1330 within the universal coupling adapter 1200, the bore brush cleaning tool 1330 can be used with embodiments of firearm barrel cleaners, shafts, cleaning attachments for example including the engagement recess 305 and/or universal coupling recess 14*a*, 14*b* according to the application. The universal coupling adapter 1200 can be formed to fit cleaning tools of different sizes (e.g., rifle, shotgun), and corresponding external threaded portions.

In one embodiment, the engagement recess 305 can be attached to the end 1250 of a universal coupling adapter 1200 according to the application where the second end 1250' of the universal adapter can include threads (e.g., internal) for threaded bore 1210 to match a corresponding external thread of a related art cleaning tool such as shown in FIG. 13.

Figure 14:
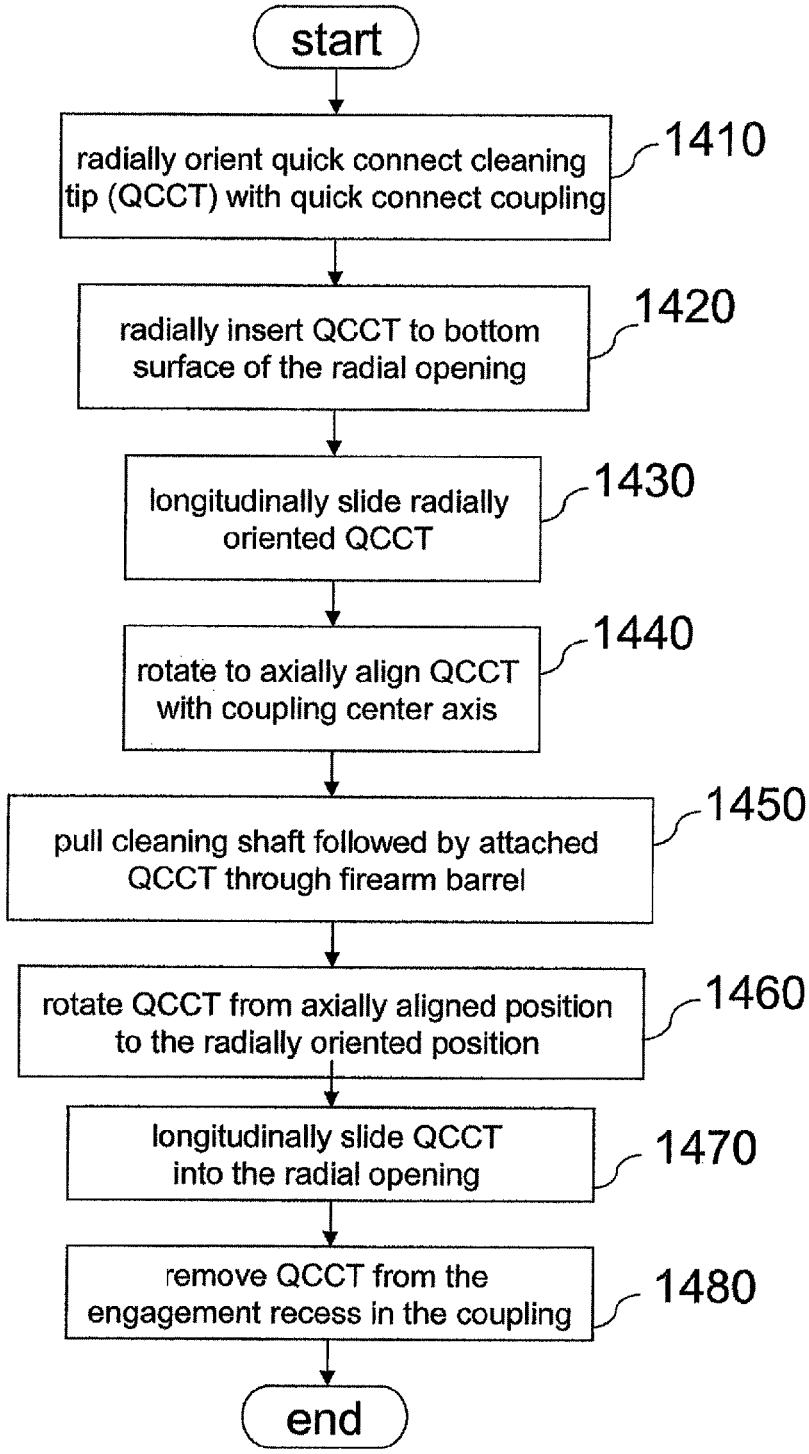
FIG. 14 is a flowchart of an exemplary method of attaching a cleaning tool to a flexible shaft according to an embodiment of the application.

Referring to FIG. 14, a flow chart of an exemplary method of attaching a cleaning tool to a cleaning shaft in a firearm cleaning kit according to embodiments of the application will now be described. The method for attaching a cleaning tool to a firearm barrel cleaning shaft will be described using and can be applied to the firearm barrel cleaner 10 shown in FIG. 1; however, the method of FIG. 14 is not intended to be limited to those structures.

Referring to FIG. 14, after a process starts, the bore brush cleaning tool 30 can be radially aligned with the opening 310 in the engagement recess 305 (operation block 1410). Then, the stem 70 of the bore brush cleaning tool 30 can be radially inserted to touch a bottom surface 345 of the radial opening 310. The bore brush cleaning tool 30 radially extends out of the radial opening 310 (operation block 1420). The bore brush cleaning tool 30 can be longitudinally slid toward the end 350 of the universal coupling recess 14*a* while remaining in the radially extending position until reaching the second portion 327 of the channel 320. The bore brush cleaning tool 30 extends through the upper portion 322 of the first portion 325 (operation block 1430). Remaining in the optional third portion 329 or at the longitudinal end of the first portion 325 of the channel 320, the bore brush cleaning tool 30 can be rotated to be axially aligned with the center axis of the coupling 300. For example, additional longitudinal force can be used to rotate the bore brush cleaning tool 30 from the radially extending position with the second section 820 passing through the upper portion 322 in the first portion 325 into the axially aligned position with the second portion 820 passing through the lower portion 324 in the second portion 327 (operation block 1440) e.g., see FIGS. 10A-10B. Then, the second end 18*b* of the flexible cleaning shaft 12 can be passed through the barrel of the firearm to be cleaned from muzzle to breach followed by the first end 18*a* including first coupling 14*a* and the attached bore brush cleaning tool 30 (e.g., tip 800). Lateral force on the second end 18*b* of the cleaning shaft will pull the first end 18*a* of the cleaning shaft having universal coupling recess 14*a* with bore brush cleaning tool 30 axially aligned and engaged in the engagement recess 305 through the barrel of the firearm (operation block 1450). The longitudinal or axial force causes the stem 805 of the bore brush cleaning tool 30 to maintain the bore brush cleaning tool 30 in an axially aligned position. In one embodiment, force of the first portion of the stem 70 against the first portion 325 of the channel 320 (e.g., transitional portion 329) provides the force to maintain the axial alignment of the bore brush cleaning tool. Further, the stem 805 in the engagement recess 305 of the first coupling 14*a* allows the bore brush cleaning tool 30 to spin or rotate or agitate while maintaining the axial alignment, for example, while passing through the firearm barrel.

Then, the bore brush cleaning tool 30 can be removed from the shaft 12. The bore brush cleaning tool 30 can be rotated from an axially aligned position to the position extending from the first portion 325 of the channel 320 in the first coupling 14*a* (operation block 1460). The radially extending bore brush cleaning tool 30 can be slid longitudinally toward and into the radial opening 310 of the engagement recess 305 in the first coupling 14*a* e.g., while maintaining a radially extending position (operation block 1470). Then, the bore brush cleaning tool 30 can be removed from the radial opening 310 of the engagement recess 305 in the first coupling 14*a* to separate the bore brush cleaning tool 30 from the first coupling 14*a* (operation block 1480). From operation block 1480, the process can end or a different cleaning tool can be attached to the first coupling 14*a* for cleaning the firearm. Although described in sequence, it is understood that operations described in the method of FIG. 14 can be performed in various sequences or in parallel.

In one embodiment, the cleaning tool can be inserted radially and immediately rotated to an axially aligned operational position. In such an embodiment, operation blocks 1430, 1470 would not be used. In another embodiment, the cleaning tool can be longitudinally slid or inserted in a position other than radially extended.

In another embodiment, an exemplary engagement recess (e.g., channel and/or radial opening) of the coupling (e.g., 14*a*, 14*b*, 300) can be angled, helical, or non-linear.

Alternate embodiments of the firearm barrel cleaner and methods of using same can include a flexible shaft 12 including various combinations including at least one universal coupling recess 14*a* and/or at least on universal coupling tip 800 (e.g., at one end of the flexible shaft 12). In one embodiment, the flexible shaft can include universal coupling (e.g., 14*a*) and tee-handle cleaning took (e.g., cleaning tool 26) at opposite ends 18*a*, 18*b*. In one embodiment, the flexible shaft can include universal coupling recess 14*a* and an internal threaded bore (e.g., bore 1210) at opposite ends. Alternatively, the universal coupling adapter 1200 can be attached to one end of flexible shaft 12.

Figure 15:
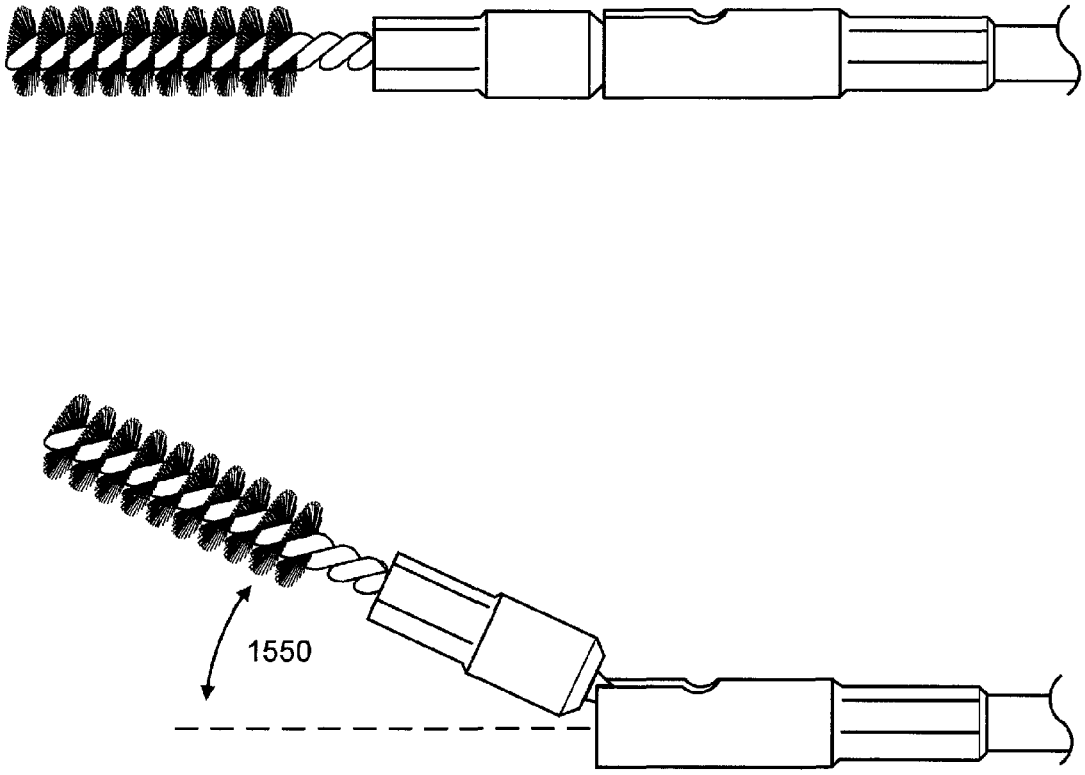
FIG. 15 is a diagram that shows a perspective view of an exemplary cleaning tool attached to an exemplary cleaning shaft according to an embodiment of the application.

In one embodiment, the attached portion of the cleaning tool having universal coupling tip 800 in universal coupling recess 300 at one end of the shaft 12 is configured to include a prescribed range of motion. For example, the range of motion in the attached portion can include movement between 0-10°, 1-20°, 0-30°, or 0-45° from the center axis. As shown in FIG. 15, an exemplary range of motion can encompass angle 1550. In embodiments having a range of motion in the attached portions, the cleaning tool cannot be removed when positioned at angle 1550 without additional force (e.g., manual force) being applied. The range of motion in the attached portion can reduce the chance of accidently or improperly inserting the cleaning tool into the firearm barrel rather than pulling the cleaning tool through the firearm barrel following the cleaning shaft.

In one embodiment, shown in FIGS. 8A and 8B, the attached portion of the cleaning tool having universal coupling tip 800 is configured to include an alignment urging member 888 extending from the end 850 and positioned near the outer circumference of the end 850. For example, the alignment urging member 888 can have a width W1 less than the channel 320 (FIG. 3A) or less than 50% of the width of the channel 320 and a height L4 extending from the end 850 less than L3 (e.g., see FIG. 10A). In operation, the alignment urging member 888 can be aligned to pass through the channel 320 when the universal coupling tip 800 is inserted and rotated to face a portion of the end 850 when the universal coupling tip 800 is axially mounted in a corresponding universal coupling recess. The alignment urging member can operate to allow rotational movement of a cleaning tool during use but can reduce or eliminate the angle 1550 or range of motion (e.g., except when oriented to the channel 320). However, the alignment urging member is not intended to be limited thereby. For example, in one embodiment, a projection on the stem 805 can be configured to match and annular notch (e.g., spanning the body between sides of the channel 320) can reduce or eliminate the angle 1550 when the notch is in the annular notch and not aligned with the channel 320.

Embodiments of a firearm barrel cleaner and methods thereof according to the application can include a fastening member to cover the engagement recess during firearm cleaning operations. In one embodiment, the fastening member can be an annular ring or cylindrical sleeve. The fastening sleeve can be sized to move between a first position and a second position over the channel 320 and/or the radial opening 310. The fastening sleeve can be made of material such as but not limited to plastic, nylon, hardened plastic, or metal. The fastening sleeve can have a first position located along the shaft 12 or over a portion of the coupling 300. The fastening sleeve can be attached to the coupling 300 or move independently. In one embodiment, the fastening sleeve can cover 10%, 25%, 50%, 75% or more of the channel 320 or engagement recess 305. Further, the fastening sleeve can be used with various adapter couplings (e.g., adapter 1200) according to the application.

Another embodiment of the firearm barrel cleaner according to the present application can be for cleaning handguns or pistols. In the handgun barrel cleaner, a plurality of cylindrical cleaning tubes, which can be selectively attached to and detached from each other are used as a variable length rigid cleaning shaft. For example, a first cylindrical cleaning tube or rod can have a universal coupling (e.g., coupling 300 or recess 305) and a threaded internal bore at opposite ends. A plurality of second cylindrical cleaning tubes or rods can have identical threaded internal bores respectively at one end and corresponding external threaded stems respectively at their other ends. First and second cylindrical cleaning tubes can be selective threadable and detachable engagement to form a variable length rigid cleaning shaft for use with the cleaning tools 20, 22, 26, 28, 30 using the universal coupling (e.g., recess 305 or coupling 300) of the first cylindrical bore. Further, one or more different sized universal coupling adapters 1200 can be included or used with the exemplary handgun barrel cleaning kit or shaft according to the application.

In operation, the exemplary handgun barrel cleaner only requires assemblage of those components necessary to accomplish the particular cleaning task desired. Relatively short individual lengths for first cylindrical rod and second cylindrical rods are preferable for storage, and cleaning of most pistol barrels and chambers. In one embodiment, lengths of the first and second cylindrical rods can be three inches.

Embodiments of a firearm barrel cleaner can be contained in a compact container. Dimensions of the container are important in that they allow container to be conveniently inserted within a typical shirt, pants, or coat pocket for carrying. An exemplary container with a short cylindrical shape can have dimensions of approximately 3 and 178 inches in diameter and 1 inch in height. For example, the container may be a rigid can (e.g., with a bottom and a lid) or a collapsible soft sided flexible material (e.g., having two portions and a zipper). Firearm barrel cleaner 10 and cleaning patches and cleaning solutions are all designed to fit within container.

As already noted, fixedly attached to at least one of the opposite ends of shaft 12 are universal coupling recess 14*a* and 14*b* and fixedly attached to one end of the shank of cleaning tools or attachments 20, 22, 26, 28, and 30 can be tips 800 (e.g., stems 36, 38, 50, 60, 70). For example, universal coupling recess 14*a*, 14*b*, and/or 300 can be manufactured of brass and fixedly attached by being crimped or cold welded. Brass is preferable since it is a "soft" metal which is less likely to scratch or otherwise damage a gun barrel. The universal coupling tip 800 can be manufactured of brass and fixedly attached by being crimped or cold welded onto the ends of the cleaning tools, cleaning shafts, or adapters.

Embodiments of quick connectors, cleaning shafts, and cleaning tools including firearm cleaning kits including the same and methods for using the same according to the application have been described with universal coupling recesses on the shaft and universal coupling tips on the cleaning tools or attachments; however, the universal coupling tips can be attached to the shaft (e.g., shaft 12) and universal coupling recesses can be on the cleaning tools. Further, embodiments can interchange or use universal coupling adapters on one or both of the shaft and cleaning tools. In addition, for example, the universal coupling adaptors can be fitted with an engagement recess or a stem.

Exemplary embodiments of universal coupling recess and universal coupling tips were described according to the application. In one embodiment, universal coupling recess can be considered a female connector configuration and universal coupling tip can be considered a male connector configuration.

As described herein, the radial opening 310 is not intended to be limited to a uniform circular hole. Other apertures shaped to pass an engagement end of stem 805 can be used. For example, the radial opening can include other cross-sectional shapes such as but not limited to rectangle, polygons, triangle, oval, slot or the like, and can increase or decrease in size or change shape or not extend radially.

Other configurations for the channel 320 can be used that can insert and longitudinally align the stem to a universal coupling recess.

As described herein, the stem 805 is not intended to be limited to shapes or configurations shown in the application as other shapes and configurations can be used to radially and/or longitudinally pass through the universal coupling recess to be aligned longitudinally to the coupling. For example, exemplary universal coupling tips can include other cross-sectional shapes such as but not limited to rectangle, polygons, triangle, oval, slot or the like, and can increase or decrease in size or change shape.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been set forth, it will be understood that features and aspects that have been described with reference to each particular embodiment can be used with each remaining particularly set forth embodiment.

I claim:

1. A comprising:

a shaft;

at least one cleaning attachment;

at least one universal coupling fixedly attached to the shaft or at least one cleaning attachment, each coupling to include an engagement recess comprising a radial opening and a longitudinal slot extending between the radial opening and an end of the universal coupling, the longitudinal slot comprising a first outer portion and a second inner portion; and at least one universal tip fixedly attached to the other of the shaft or the at least one cleaning attachment, each of said universal cleaning tip to include a stem connector, the stem connector comprising a first engaging portion and a second portion projecting from one end of each universal cleaning tip to the first engaging portion, wherein the second portion is smaller than the first portion, and further wherein the first outer portion of the longitudinal slot is sized to pass the second portion and the second inner portion of the longitudinal slot is sized to hold the first engaging portion, the universal tip further comprising an attachment urging member extending from the one end of the universal tip and positioned near an outer circumference thereof and rotatable within the engagement recess about a longitudinal axis extending through the first and second engaging portions of the universal tip.

2. The firearm barrel cleaner of claim 1, wherein the engagement recess comprises a channel having an upper portion and a lower portion, the lower portion of the channel narrows before the end of the universal coupling to form an alignment portion to align the stem connector in the universal coupling to an axis of the at least one universal coupling.

3. The firearm barrel cleaner of claim 1, wherein the stem connector is configured to rotate or spin when axially aligned and attached in the engagement recess.

4. The firearm barrel cleaner of claim 1, wherein the stem connector is radially attached and longitudinally secured to be attachable and detachable to the engagement recess of the at least one universal coupling.

5. The firearm barrel cleaner of claim 1, comprising a first adapter universal coupling including a threaded internal bore at one end and the stem connector or the engagement recess at the other end, the threaded internal bore sized to receive an externally threaded shank of a cleaning tip sized for a hand gun, a rifle, or a shotgun.

6. The firearm barrel cleaner of claim 1, wherein the stem connector can rotate 0° to 30° into the longitudinal slot when longitudinally attached to the engagement recess.

7. The firearm barrel cleaner of claim 1, further comprising two universal tips at opposite ends of the shaft and the universal coupling is at a distal end of a shank of the at least one cleaning attachment.

8. The firearm barrel cleaner of claim 1, further comprising two universal couplings at opposite ends of the shaft and the universal tip is at a distal end of a shank of the at least one cleaning attachment.

9. The firearm barrel cleaner of claim 1, wherein the longitudinal slot is to include a first longitudinal portion adjacent the radial opening and a second longitudinal portion, the second longitudinal portion between the first longitudinal portion and the end of the universal coupling, wherein the lower portion of the longitudinal slot is smaller in the second longitudinal portion than the lower portion of the longitudinal slot in the first longitudinal portion.

10. The firearm barrel cleaner of claim 1, comprising an alignment tab projecting from the end of the stem, the alignment tab positioned near an outer rim of the end.

11. The firearm barrel cleaner of claim 1, wherein the at least one cleaning tip comprises slotted tips, adapters, handles, obstruction removers, a tee handle, or bore brush, and wherein the at least one cleaning tip is appropriately dimensioned for use in cleaning a hand gun, a rifle barrel, or shotgun.

12. The firearm barrel cleaning of claim 1, wherein the shaft comprises a rigid cylindrical cleaning rod or a laterally bendable flexible shaft, wherein in said flexible shaft is formed of a wire interior surrounded by a flexible nylon exterior that is radially attached and longitudinally secured to the universal coupling or universal tips.

13. The firearm barrel cleaner of claim 1, wherein the attachment urging member has a width less than the engagement recess.

14. The firearm barrel cleaner of claim 1, wherein the attachment urging member projects from the end of the universal tip a distance less than a length L3 formed by the space between the universal coupling and the attached universal tip.

15. A method of using firearm cleaning kit, comprising:

providing a firearm barrel cleaning shaft extending longitudinally between a first end and a second end;

providing a plurality of cleaning tools having a utility end and a distal attachment end, the distal attachment end having an alignment urging member positioned near an outer circumference thereof and extending longitudinally therefrom;

attaching a first cleaning tool to the firearm barrel cleaning shaft by radially inserting the attachment end into an engagement recess near the second end of the firearm barrel cleaning shaft and pivoting the inserted attachment end to align with a longitudinal axis of the firearm barrel cleaning shaft;

rotating the first cleaning tool about the longitudinal axis such that the alignment urging member prevents the tool from pivoting; and detaching the first axially aligned tool from the second end of the firearm barrel cleaning shaft by aligning the alignment urging member with the engagement recess and pivoting the attachment end of the first cleaning tool in the engagement recess to extend radially from the engagement recess and moving the attachment end radially out of the engagement recess of the firearm barrel cleaning shaft.

16. The method of claim 15, comprising passing the first end of the firearm barrel cleaning shaft followed by the second end and the axially aligned first cleaning tool through a firearm barrel, wherein the axially aligned first cleaning tool can reciprocally spin or vibrate when passing through the firearm barrel.

17. The method of claim 16, wherein the cleaning tool comprises slotted tips, adapters, handles, obstruction removers, a tee handle, or bore brush.

18. The method of claim 15, wherein attaching the first cleaning tool and detaching the first axially aligned tool comprises sliding the attached first cleaning tool along the engagement recess between the radial movement and the pivoting movement.

* * * * *